US007604678B2

(12) United States Patent
Poszmik

(10) Patent No.: US 7,604,678 B2
(45) Date of Patent: Oct. 20, 2009

(54) POWDER METALLURGICAL COMPOSITIONS CONTAINING ORGANOMETALLIC LUBRICANTS

(75) Inventor: George Poszmik, Mt. Laurel, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 800 days.

(21) Appl. No.: 10/918,604

(22) Filed: Aug. 12, 2004

(65) Prior Publication Data

US 2006/0034723 A1 Feb. 16, 2006

(51) Int. Cl.
*B22F 1/00* (2006.01)
*B22F 3/00* (2006.01)

(52) U.S. Cl. ..... 75/231; 75/252

(58) Field of Classification Search ..... 75/252, 75/231; 508/103, 107
See application file for complete search history.

(56) References Cited

U.S. PATENT DOCUMENTS

| | | | | | |
|---|---|---|---|---|---|
| 4,190,441 | A | | 2/1980 | Tengzelius et al. | 75/251 |
| 4,483,905 | A | | 11/1984 | Engstrom | 428/570 |
| 4,834,800 | A | | 5/1989 | Semel | 106/403 |
| 4,935,199 | A | * | 6/1990 | Nishio et al. | 264/624 |
| 5,069,714 | A | | 12/1991 | Gosselin | 75/252 |
| 5,108,493 | A | | 4/1992 | Causton | 75/255 |
| 5,162,558 | A | | 11/1992 | Ardaud et al. | 556/402 |
| 5,204,431 | A | | 4/1993 | Sartori et al. | 528/4 |
| 5,290,336 | A | | 3/1994 | Luk | 75/231 |
| 5,298,055 | A | | 3/1994 | Semel et al. | 75/252 |
| 5,330,792 | A | | 7/1994 | Johnson et al. | 427/217 |
| 5,368,630 | A | | 11/1994 | Luk | 75/252 |
| 5,455,000 | A | * | 10/1995 | Seyferth et al. | 419/36 |
| 5,498,276 | A | | 3/1996 | Luk | 75/252 |
| 5,641,817 | A | | 6/1997 | Aghajanian et al. | 523/141 |
| 5,892,164 | A | | 4/1999 | Garg et al. | 75/246 |
| 6,133,396 | A | | 10/2000 | Laine et al. | 528/31 |
| 6,217,984 | B1 | | 4/2001 | Bruxvoort et al. | 428/195.1 |
| 6,284,060 | B1 | * | 9/2001 | Matsutani et al. | 148/300 |
| 6,451,082 | B1 | * | 9/2002 | Ozaki et al. | 75/252 |
| 6,627,559 | B2 | * | 9/2003 | Shindo | 438/780 |
| 2001/0028859 | A1 | * | 10/2001 | Ozaki et al. | 419/35 |
| 2004/0081574 | A1 | * | 4/2004 | Poszmik et al. | 419/66 |
| 2005/0238523 | A1 | * | 10/2005 | Skoglund et al. | 419/38 |

FOREIGN PATENT DOCUMENTS

| | | |
|---|---|---|
| EP | 0 554 009 B1 | 8/1997 |
| GB | 2 315 115 | 1/1998 |
| WO | WO 99/20689 | 4/1999 |
| WO | WO 2004/037467 A1 | 5/2004 |

OTHER PUBLICATIONS

Yajima, Seishi et al.; Heat-resistant Fe-Cr alloy with polycarbosilane as binder, 1976, Nature, vol. 264, 237-238.*
Seyferth, Dietmar et al.; Application of Preceramic Polymers in Powder Metallurgy: Their Use as Low-Loss Binders and for the in Situ Formation of Dispersed Ceramic Phases in the Metal Matrix, Chem. Mater. 1994, 6, 10-12.*
Powder metal Technologies and Application, vol. 7, Powder Metallurgy Method for Rapid Prototyping.*
Baldus, H.P. et al., "Synthesis of Advanced Ceramics in the Systems Si-B-N and Si-B-N-C Employing Novel Precursor Compounds", *Materials Research Society Symposium*, 1992, 271, 821-827.
Baldus, H.P. et al., "Studies on SiBN(C)-Seramics: Oxidation- and Crystallization Behavior Lead the Way to Applications", *Materials Research Society Symposium Proceedings*, 1994, 346, 617-622.
Bill, J. et al., "Precursor-Derived Covalent Ceramics", *Advanced Materials*, 1995, 7(9),775-787.
C.W. Whitemarsh, et al., "Synthesis and Structure of a Highly Branched Polycarbosilane Derived from (Chloromethyl) trichlorosilane", *Organometallics*, 1991, 10, 1336-1344.
Dorn, H. et al, "Transition Metal-Catalyzed Formation of Phosphorus-Boron Bonds: A New Route to Phosphinoborane Rings, Chains, and Macromolecules", *J. Am. Chem. Soc.*, 2000, 122, 6669-6678.
Dorn, H. et al., "Rhodium-Catalyzed Formation of Phosphorus-Boron Bonds: Synthesis of the First High Molecular Weight Poly(phosphinoborane)", *Angew. Chem. Int. Ed. Engl.*, 1999, 38(22),3321-3323.
Mark, J.E. et al., *Inorganic Polymers*, 1992, 1 thru 272 (Entire Book).
Muller, A. et al., "Si-B-C-N Ceramic Precursors Derived from Dichlorodivinylsilane and Chlorotrivinylsilane. 1. Precursor Synthesis", *Chem Mater*, 2002, 14, 3398-3405.
Sorarù, G.D., "Silicon Oxycarbide Glasses from Gels", *Journal of Sol-Gel Science and Technology*, 1994, 2, 843-848.
Yamamura, T. et al., "Development of a New Continuous Si-Ti-C-O Fibre Using an Organometallic Polymer Precursor", *Journal of Materials Science*, 1988, 23, 2589-2594.

* cited by examiner

*Primary Examiner*—Roy King
*Assistant Examiner*—Ngoclan T Mai
(74) *Attorney, Agent, or Firm*—Woodcock Washburn LLP

(57) ABSTRACT

The present invention relates to improved metallurgical powder compositions, methods for the preparation of those compositions, and methods for using those compositions to make compacted parts. The metallurgical powder compositions comprise a base metal powder, such as an iron-based or nickel-based powder, to which is added or blended an organometallic lubricant. Organometallic lubricants are monomers or polymers having a metal-carbon bond or metalloid-carbon bond on the polymer backbone, which degrade into physical property enhancing compounds upon heating. The metallurgical powder compositions can also comprise small amounts of other commonly used alloying powders, binding agents, and lubricants.

9 Claims, No Drawings

POWDER METALLURGICAL COMPOSITIONS CONTAINING ORGANOMETALLIC LUBRICANTS

FIELD OF THE INVENTION

This invention relates to metallurgical powder compositions, parts made therefrom, and methods of making the same. More particularly, the invention relates to metallurgical powder compositions including organometallic lubricants.

BACKGROUND OF THE INVENTION

Iron-based particles have long been used as a base material in the manufacture of structural components by powder metallurgical methods. The iron-based particles are optionally combined with powder metallurgical additives, such as for example lubricants or alloying materials, and molded in a die under high pressures to produce a desired shape. After the molding step, the compacted or "green" component may undergo a sintering step to further densify the component.

Traditionally, metallurgical powder compositions include an internal or external lubricant to more easily eject a compact from a die cavity. The internal friction forces that must be overcome to remove a compacted part from the die are measured as "stripping" and "sliding" pressures.

Most conventionally known internal lubricants reduce the green strength of the compacted part. It is believed that during compaction the internal lubricant is exuded between iron and/or alloying metal particles such that it fills the pore volume between the particles and interferes with particle-to-particle bonding. As a result some shapes cannot be pressed using known internal lubricants. Tall, thin-walled bushings, for example, require large amounts of internal lubricant to overcome die wall friction and reduce the required ejection force. Such levels of internal lubricant, however, typically reduce green strength to the point that the resulting compacts crumble upon ejection. Also, internal lubricants such as zinc stearate often adversely affect powder flow rate and apparent density, as well as green density of the compact, particularly at higher compaction pressures. Moreover, excessive amounts of internal lubricants can lead to compacts having poor dimensional integrity, such as for example, when volatized lubricant forms soot on the heating elements of a sintering furnace.

To avoid these problems, it is known to use an external spray lubricant rather than or in addition to an internal lubricant. However, the use of external lubricants often increases the compaction cycle time and leads to less uniform compaction.

Other powder metallurgy additives include alloying materials, usually in powder form, to provide enhanced physical properties. Commonly utilized alloying powders include nickel or copper powders. At the levels used, the cost associated with these alloying additions can add up to a significant portion of the overall cost of the powder composition.

Although alloying materials may enhance select physical properties, other properties, such as for example ductility, the ability of the part to retain its shape after a strain is applied and removed, are diminished by addition of alloying materials. Copper and nickel-containing powder additions, for example, impart low ductility to finished part and thus pose certain design constraints. Additionally, certain parts manufacturers desire to limit the amount of copper and/or nickel used in the powder metallurgy compositions that are used to form compacted parts due to the environmental and/or recycling regulations that regulate the use or disposal of those parts.

Accordingly, there exists a current and long felt need in the powder metallurgical industry to develop powder metallurgical additives, such as for example, lubricants that reduce the internal friction forces that must be overcome to remove a compacted part from the die without adversely affect the physical properties of the compact. Other additives, including alloying materials are desired as alternatives to common alloying powders utilized in powder metallurgy compositions.

SUMMARY OF THE INVENTION

The present invention relates to improved metallurgical powder compositions, compacted parts made therefrom, and methods for using those compositions to make compacted parts. The metallurgical powder compositions comprise a base metal powder, such as an iron-based or nickel-based powder commonly used as the major component of a powder metallurgy composition, to which is added or blended an organometallic lubricant. Organometallic lubricants are polymers having metals or metalloids in the polymer backbone, such as for example, polysilanes, polyborazenes, or polyphosphazenes. The metallurgical powder compositions can also comprise small amounts of other commonly used alloying powders, binding agents, and lubricants.

The organometallic lubricants beneficially perform a dual role in powder metallurgy compositions acting not only as an internal lubricant/binder, but also as a source of beneficial alloying material, which enhances the physical properties of compacted parts. As an internal lubricant/binder, organometallic lubricants reduce internal friction between base metal particles during compaction, reduce the force necessary to eject a compacted part from a die cavity, and provide more uniform compaction of the metallurgical powder composition. When heated, organometallic lubricants are transformed in situ into alloying materials that enhance the physical properties of finished parts. For example, upon sintering, silicon based organometallic lubricants react in situ to form silicon carbide, which increases the sinter strength and sinter density of compacted parts.

Transforming organometallic lubricants into alloying materials provides a more homogeneous distribution of alloying material in finished parts compared to conventional alloying powders. In part, partial diffusion of the alloying material into the base powder increases the homogeneity of the metallurgical powder composition. In situ formation of the alloying material also reduces pores formation commonly exhibited with addition of conventional alloying powders.

Metallurgical powder compositions are prepared by adding organometallic lubricant in particulate or liquid form to metal-based powders. Similarly, metallurgical powder compositions can be prepared by substantially coating the metal-based powder with solid organometallic lubricant.

Methods for making a compacted metal part include the steps of providing a metallurgical powder composition composed of a based metal powder and an organometallic lubricant, compressing the metallurgical powder composition, and sintering the compact part at a temperature of at least 2000° F.

DETAILED DESCRIPTION OF ILLUSTRATIVE EMBODIMENTS

The present invention relates to metallurgical powder compositions, compacted parts made therefrom, and methods of making compacted parts. The metallurgical powder compositions comprise a base metal powder, such as an iron-based or nickel-based powder, to which is added or blended an organometallic lubricant. Organometallic lubricants are monomers or polymers having a metal-carbon bond or metalloid-carbon bond on the polymer backbone, which degrade upon heating into compounds that enhance the physical properties of the compacted parts. The metallurgical powder compositions can also contain small amounts of other commonly used alloying powders, binding agents, and lubricants.

The metallurgical powder compositions include one, or a blend of more than one, metal-based powder of the kind generally used in the powder metallurgy industry, such as for example, powders prepared by atomization techniques. These metal powders constitute a major portion of the metallurgical powder composition, and generally constitute at least about 80 weight percent, preferably at least about 90 weight percent, and more preferably at least about 95 weight percent of the metallurgical powder composition. Preferably, the base metal powder is an iron-based powder.

Iron-based powder include atomized iron powder, sponge iron, other types of iron powder, or mixtures thereof. Advantageously, however, the iron based powder contains at least 50 weight percent, preferably at least 75 weight percent, more preferably at least 90 weight percent, and most preferably about 100 weight percent, of an atomized iron based powder.

Examples of iron-based powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded and mixtures thereof. Substantially pure iron powders that can be used in the invention are powders of iron containing not more than about 1.0% by weight, preferably no more than about 0.5% by weight, of normal impurities. These substantially pure iron powders are preferably atomized powders prepared by atomization techniques.

Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85-3.00 g/cm$^3$, typically 2.94 g/cm$^3$. Other substantially pure iron powders that can be used in the invention are typical sponge iron powders, such as Hoeganaes' ANCOR MH-100 powder.

Metal-based powders can incorporate one or more alloying elements that enhance the mechanical or other properties of the final metal part. Alloying elements can be added in particulate form or pre-alloyed into metal-based powders. As used herein, "alloying powders" refers to materials that are capable of diffusing into iron-based or nickel-based materials upon sintering.

The alloying powders that can be admixed with metal-based powders are those known in the metallurgical powder field to enhance the strength, hardenability, electromagnetic properties, or other desirable properties of the final sintered product. Steel-producing elements are among the best known of these materials. Specific examples of alloying materials include, but are not limited to elemental molybdenum, manganese, chromium, silicon, copper, nickel, tin, vanadium, columbium (niobium), metallurgical carbon (graphite), phosphorus, aluminum, sulfur, and combinations thereof. Other suitable alloying materials are binary alloys of copper with tin or phosphorus; ferro-alloys of iron with manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum. Pre-alloyed iron powders that incorporate such alloying elements are available from Hoeganaes Corp. as part of its ANCORSTEEL line of powders.

In some embodiments, the particle size of metal based powders and alloying powders can be relatively low. At these lower particle size ranges, the particle size distribution is preferably analyzed by laser light scattering technology as opposed to screening techniques using, for example, a MicroTrac II Instrument made by Leeds and Northrup, Horsham, Pa. Laser light scattering technology reports the particle size distribution in dx values, where it is said that "x" percent by volume of the powder has a diameter below the reported value.

Alloying powders are in the form of particles that are generally of finer size than the particles of metal powder with which they are admixed. The alloying particles generally have a particle size distribution such that they have a d90 value of below about 100 microns, preferably below about 75 microns, and more preferably below about 50 microns; and a d50 value of below about 75 microns, preferably below about 50 microns, and more preferably below about 30 microns.

The amount of alloying powder present in the composition will depend on the properties desired of the final sintered part. Generally the amount will be minor, up to about 7.5% by weight of the total powder composition, although as much as 10-15% by weight can be present for certain specialized powders. A preferred range is typically from about 0.05 to about 5.0% by weight. In another embodiment, a suitable range for most applications is about 0.25-4.0% by weight. Particularly preferred alloying elements for use in the present invention for certain applications are copper and nickel, which can be used individually at levels of about 0.25-4% by weight, and can also be used in combination. Another preferred alloying element is carbon, added in the form of graphite.

In one embodiment, iron-based powders are powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

A further example of iron-based powders are diffusion-bonded iron-based powders which are particles of substantially pure iron that have a layer or coating of one or more other alloying elements or metals, such as steel-producing elements, diffused into their outer surfaces. A typical process for making such powders is to atomize a melt of iron and then combine this atomized powder with the alloying powders and anneal this powder mixture in a furnace. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is one of iron pre-alloyed with molybdenum (Mo). The powder is produced by atomizing a melt of substantially pure iron containing from about 0.5 to about 2.5 weight percent molybdenum. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Other analogs include ANCORSTEEL 50HP and 150HP, which have similar compositions to the 85HP powder, except that they contain 0.5 and 1.5% molybdenum, respectively. Another example of such a powder is Hoeganaes' ANCORSTEEL 4600V steel powder, which contains about 0.5-0.6 weight percent molybdenum, about 1.5-2.0 weight percent nickel, and about 0.1-0.25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5-2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders are commercially available in various grades in the Hoeganaes ANCOR® series, such as the ANCOR® 303L, 304L, 316L, 410L, 430L, 434L, and 409Cb powders. Also, iron-based powders include tool steels made by the powder metallurgy method.

The particles of the iron-based powders, such as the substantially pure iron, diffusion bonded iron, and pre-alloyed iron, have a distribution of particle sizes. Typically, these powders are such that at least about 90% by weight of the powder sample can pass through a No. 45 sieve (U.S. series), and more preferably at least about 90% by weight of the powder sample can pass through a No. 60 sieve. These powders typically have at least about 50% by weight of the powder passing through a No. 70 sieve and retained above or larger than a No. 400 sieve, more preferably at least about 50% by weight of the powder passing through a No. 70 sieve and retained above or larger than a No. 325 sieve. Also, these powders typically have at least about 5 weight percent, more commonly at least about 10 weight percent, and generally at least about 15 weight percent of the particles passing through a No. 325 sieve. As such, these powders can have a weight average particle size as small as one micron or below, or up to about 850-1,000 microns, but generally the particles will have a weight average particle size in the range of about 10-500 microns. Preferred are iron or pre-alloyed iron particles having a maximum weight average particle size up to about 350 microns; more preferably the particles will have a weight average particle size in the range of about 25-150 microns, and most preferably 80-150 microns. Reference is made to MPIF Standard 05 for sieve analysis.

The iron-based powders can have particle size distributions, for example, in the range of having a d50 value of between about 1-50, preferably between about 1-25, more preferably between about 5-20, and even more preferably between about 10-20 microns, for use in applications requiring such low particle size powders, e.g., use in metal injection molding applications.

The metal-based powder used as the major component in the present invention, in addition to iron-based powders, can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying powders mentioned previously with respect to the iron-based powders. Examples of nickel-based powders include those commercially available as the Hoeganaes ANCORSPRAY® powders such as the N-70/30 Cu, N-80/20, and N-20 powders. These powders have particle size distributions similar to the iron-based powders. Preferred nickel-based powders are those made by an atomization process.

The metallurgical powder compositions include one, or a blend of more than one, organometallic lubricant. Organometallic lubricants are monomers or polymers having a metal-carbon bond or metalloid-carbon bond on the polymer backbone, which degrade into physical property enhancing compounds upon heating. Suitable metals include both main group and transition metals selected from the group consisting of metalloids and metals selected from IUPAC groups 1 through 15 of the periodic table of elements inclusive. Metalloids, include for example, silicon, boron, phosphorus, sulfur, germanium, arsenic, antimony, and tellurium.

Utilizing organometallic lubricants provides improved lubricant properties by reducing internal friction between base metal particles during compaction, reducing the force necessary to eject a compacted part from a die cavity, and providing more uniform compaction of the metallurgical powder composition. Improved lubricant properties are generally illustrated by reduced stripping and sliding pressures. Strip pressure measures the static friction that must be overcome to initiate ejection of a compacted part from a die. Slide pressure is a measure of the kinetic friction that must be overcome to continue the ejection of the part from the die cavity.

When heated, organometallic lubricants decompose in situ via pyrolysis to form physical property enhancing compounds, i.e., alloying compounds. Without being limited by theory, it is believed that in situ formation of physical property enhancing compounds yields a more homogeneous grain structure compared to addition of particulate alloying compounds thereby providing improved physical properties. In situ formation of the alloying material also reduces pore formation commonly exhibited with addition of conventional alloying powders.

The dual role performed by organometallic lubricants reduces the need for some conventional powder additives thereby reducing the cost of powder metallurgical compositions. For example, organometallic lubricants reduce the need for conventional lubricants that undesirably "burn up" during high temperature processing thereby leaving unwanted materials, e.g., soot, in the powder metallurgical composition. Further, utilizing organometallic lubricants as precursors to physical property enhancing compounds reduces the need for powdered additives, such as silicon carbide powders, that are abrasive and damaging to a die thereby decreasing die wear and increasing the useable life of the die.

Organometallic lubricants include polysilazanes, polyureasilazanes, polythioureasilazanes, polycarbosilanes, polysilanes, polysiloxanes, polyborosilazanes, polyaminosilazanes, polyaminoboranes, polyalazanes, polyborazanes, polyphosphazenes, polyphosphinoboranes that are commonly known to those skilled in the art. Organometallic lubricants are generally described in Mark, Allcock, & West, *Inorganic Polymers*, (1992), Manners, *Angew. Chem. Int. Ed. Engl.*, v. 36, p. 1602, (1996), Dorn, H.; Singh, R. A.; Massey, J. A., Lough, A. J.; Manners, I., *Angew. Chem. Int. Ed. Engl.*, v. 38, p. 3321, (1999), Dorn, H.; Singh, R. A.; Massey, J. A., Nelson, J. M.; Jaska, C. A., Lough, A. J.; Manners, I., *J. Am. Chem. Soc.*, v. 122, p. 6669, (2000), J Bill & F. Aldinger, *Adv.*

*Mater*., v. 7, p. 775, (1995), H. P. Baldus, et al., *Mats. Res. Soc. Sympos*., v. 271, p. 821, (1992), H. P. Baldus, et al., *Mats. Res. Soc. Sympos*., v. 345, p. 617, (1994), A. Muller. et. al., *Chem Mater*. v. 14, pp. 3398, 3408, (2002), Sorarù, G. D.; *J. Sol-Gel Sci. and Technol*., v. 2, p. 843, (1994), T. Yamamura, et. al., *J. Mater. Sci*., v. 23, p. 258, (1988), C. W. Whitemarsh & L. V. Interrante, *Organometallics*, v. 10, p. 1341 (1991), each of which is herein incorporated by reference in its entirety.

Exemplary organometallic lubricants are also described in, for example, U.S. Pat. No. 5,162,558 which describes organometallic boron/nitrogen polymers, U.S. Pat. No. 5,204,431 which describes polycarbosilanes wherein some silicon atoms have been replaced with a hetero element, U.S. Pat. No. 6,133,396 which describes non-pyrophobic polymethylsilane, and U.S. Pat. No. 5,641,817 which describes organometallic ceramic compounds, each one of which is herein incorporated by reference in its entirety.

Organometallic lubricants include compounds having the formula:

(a)

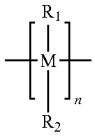

(b)

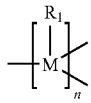

(c)

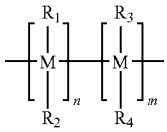

(d)

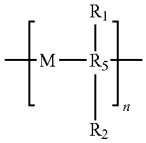

(e)

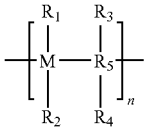

(f)

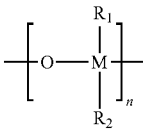

(g)

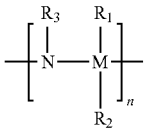

(h)

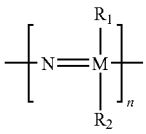

-continued and (i)

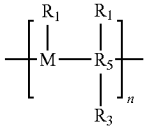

wherein M is a metalloid. Preferably M is silicon, boron, or phosphorus. $R_1$ is a alkyl group, an alkenyl group, an alkynyl group, a cycloalkyl group, an alkoxy group of $C_{1-20}$, an aryl group, an alkylaryl group, an arylalkyl group of $C_{6-20}$, $NH_2$, oxygen, or hydrogen. $R_2$ is independently a alkyl group, an alkenyl group, an alkynyl group, a cycloalkyl group, an alkoxy group of $C_{1-20}$, an aryl group, an alkylaryl group, an arylalkyl group of $C_{6-20}$, $NH_2$, oxygen, or hydrogen. $R_3$ is independently a alkyl group, an alkenyl group, an alkynyl group, a cycloalkyl group, an alkoxy group of $C_{1-20}$, an aryl group, an alkylaryl group, an arylalkyl group of $C_{6-20}$, $NH_2$, oxygen, or hydrogen. $R_4$ is independently a alkyl group, an alkenyl group, an alkynyl group, a cycloalkyl group, an alkoxy group of $C_{1-20}$, an aryl group, an alkylaryl group, an arylalkyl group of $C_{6-20}$, $NH_2$, oxygen, or hydrogen. $R_5$ is independently carbon, an alkylene group, an alkenylene group, an alkynylene group, a cycloalkyl group, an arylene group, an alkylaryl group; Variables "n" and "m" are each independently an integer from 1 to 1000. Preferably, "n" and "m" are each independently an integer from 4 to 100. More preferably, "n" and "m" are each independently an integer from 4 to 50, and even more preferably, "n" and "m" are each independently an integer from 5 to 30.

As used herein, "alkyl" is intended to include both branched and straight-chain saturated aliphatic hydrocarbon groups, examples of which include, but are not limited to, methyl, ethyl, n-propyl, i-propyl, n-butyl, i-butyl, sec-butyl, t-butyl. Cycloalkyl groups including saturated and partially unsaturated ring groups, including for example, mono-, bi- or poly-cyclic ring systems, such as cyclopropyl, cyclobutyl, and cyclopentyl. The term "alkoxy" means an alkyl-CO— group wherein alkyl is as previously described. Exemplary groups include methoxy, ethoxy, and so forth. As used herein, the term "alkenyl" is intended to include hydrocarbon chains of either a straight or branched configuration and one or more unsaturated carbon-carbon bonds which may occur in any stable point along the chain, such as ethenyl, propenyl, and the like. As used herein, the term "alkynyl" is intended to include hydrocarbon chains having the specified number of carbon atoms of either a straight or branched configuration and one or more unsaturated carbon-carbon triple bonds which may occur in any stable point along the chain.

Organometallic lubricants are commercially available as Polycarbomethylsilane, MW 1400 and Polycarbomethylsilane, MW 800 from Sigma-Aldrich corporation of St. Louis, Mo., Nicalon™ fibers from Nippon Carbon, ($SiC_{1.45}O_{0.36}H_{0.03}$), Tyranno™ fibers from Ube Industries ($SiC_{1.43}O_{0.46}T_{0.13}$), and Mark I polymer from Shin-Etsu Co.

Organometallic lubricants are preferably silicon-based polymers, boron-based polymers, or phosphorus-based polymers. More preferably organometallic lubricants are silicon based polymers.

Silicon based organometallic lubricants have silicon atoms in the backbone of a polymer chain, such as those compounds shown in formulas (a) though (i) wherein M is silicon. Silicon based organometallic lubricants include, for example, polysilazanes, polyureasilazanes, polythioureasilazanes, polycarbosilanes, polysilanes, polysiloxanes, polyborosilazanes, and polyaminosilazanes that are commonly known to those skilled in the art.

Silicon based organometallic lubricants decompose via pyrolysis to typically yield SiC, $Si_3N_4$, $SiO_2$, and $SiO_xC_y$, and other mixed phase products. In situ decomposition of silicon-based organometallic lubricants causes silicon carbide formation and diffusion into the base metal matrix such that silicon carbide alloys with the base metal. In situ formation of silicon carbide compounds as an alloying element provides compacted parts having higher hardness and strength values after sintering compared to conventionally prepared compositions. The use of silicon carbide in the manner described also reduces the need for post sintering heat treatment steps to improve the hardness of a sintered part.

In a preferred embodiment, silicon based organometallic lubricants have the formula:

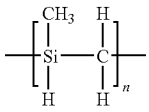

wherein n is an integer from 1 to 1000.

Silicon based organometallic lubricants generally provide powder metallurgical compositions with at least about 0.05 weight percent silicon, based on the total weight of the powder metallurgical composition. Preferably, silicon based organometallic lubricants provide powder metallurgical compositions with from about 0.05 to about 4.0 weight percent silicon, and more preferably from about 0.05 to about 3.0 weight percent silicon. More preferably, silicon based organometallic lubricants provide powder metallurgical compositions with from about 0.1 to about 2.0 weight percent silicon, and more preferably from about 0.1 to about 1.5 weight percent silicon.

Boron based organometallic lubricants have boron atoms in the backbone of a polymer chain, such as for example those compounds shown in formula (i) wherein M is boron. Boron based organometallic lubricants include, for example, polyboranes, polyaminoboranes, polycarboranes, and polyborazanes that are commonly known to those skilled in the art.

Boron based organometallic lubricant decomposition typically yields boronitride or borocarbide and other mixed phase products. In situ decomposition of boron-based organometallic lubricants causes boron compound formation and diffusion into the base metal matrix so that boron compounds alloy with the base metal. In situ formation of boron compounds as alloying materials provides improved strength compared to conventionally prepared compositions. For example, as boron diffuses into iron based powders beneficial ferroboron compounds form, which improves the physical properties of the powder metallurgical composition. Also, boron compounds formed in situ during heat treatments take part in liquid phase sintering thereby increasing sinter density.

Boron based organometallic lubricants generally provide powder metallurgical compositions with at least about 0.01 weight percent boron, based on the total weight of the powder metallurgical composition. Preferably, boron based organometallic lubricants provide powder metallurgical compositions with from about 0.01 to about 3.0 weight percent boron, and more preferably from about 0.01 to about 2.0 weight percent boron. More preferably, boron based organometallic lubricants provide powder metallurgical compositions with from about 0.01 to about 0.5 weight percent boron, and more preferably from about 0.05 to about 0.5 weight percent boron.

Phosphorus based organometallic lubricants have phosphorus atoms in the backbone of a polymer chain such as for example those compounds shown in formula (h) wherein M is phosphorus. Phosphorus based organometallic lubricants include, for example, polyphosphazenes that are commonly known to those skilled in the art.

In some embodiments, organometallic lubricants include polymers having combinations of silicon atoms, boron atoms, and phosphorus atoms in the backbone of a polymer chain. These organometallic lubricants include, for example, polyborasilazanes and poly phosphinoboranes that are commonly known to those skilled in the art.

Organometallic lubricants preferably have a pyrolysis yield in excess of 20 percent by weight, preferably in excess of 40 percent by weight, and more preferably in excess of 50 percent by weight when thermally decomposed.

The molecular weight of the organometallic lubricants can be varied to provide different properties. Organometallic lubricants having a higher molecular weight exhibit better binding properties. Organometallic lubricants having a lower molecular weight exhibit better lubricant properties. Generally organometallic lubricants have a weight average molecular weight of at least about 25. Preferably, organometallic lubricants have a weight average molecular weight of from about 25 to about 100,000. More preferably, organometallic lubricants have a weight average molecular weight of from about 100 to about 50,000. Still more preferably, organometallic lubricants have a weight average molecular weight of from about 200 to about 10,000. Even still more preferably organometallic lubricants have a molecular weight of from about 200 to about 4000.

Organometallic lubricants can generally be any particle size, or particle size distribution, of conventionally known internal lubricants. Preferably, however, organometallic lubricants have a weight average particle size between about 2 and 200 microns, more preferably between about 5 and about 150 microns, and even more preferably between about 10 and 110 microns. Preferably about 90% by weight of the organometallic lubricant particles are below about 200 microns, preferably below about 175 microns, and more preferably below about 150 microns. Particle size is measured by conventional laser diffraction methods.

Metallurgical powder compositions generally include from about 0.01 to about 5.0 weight percent of organometallic lubricant. Preferably, metallurgical powder compositions include from about 0.1 to about 5.0 weight percent, more preferably from about 0.1 to about 3.0 weight percent, of organometallic lubricant. Still more preferably, metallurgical powder compositions include from about 0.1 to about 2.0 weight percent of organometallic lubricant. The organometallic lubricant can be a single type of lubricant or a mixture of several organometallic lubricants.

The metallurgical powder compositions can also contain a conventional internal or external lubricant commonly known to those skilled in the powder metallurgical art. Examples of such traditional lubricants include stearate compounds, such as lithium, zinc, manganese, and calcium stearates commercially available from Witco Corp., and polyolefins commercially available from Shamrock Technologies, Inc. Mixtures of zinc and lithium stearates lubricants are commercially available from Alcan Powders & Pigments as Ferrolube M. Mixtures of ethylene bis-stearamides/metal stearates lubricants such as Witco ZB-90. Other conventional lubricants that can be used as part of the total lubricant content include waxes such as ethylene bis-stearamides, polyethylene wax, and polyolefins, and mixtures of these types of lubricants. Exemplary lubes are commercially available as ACRAWAX from Lonza Corporation and KENOLUBE from Hoeganaes AG of Sweden.

Additional suitable lubricants include those containing a polyether compound such as is described in U.S. Pat. No. 5,498,276 to Luk, and those useful at higher compaction temperatures described in U.S. Pat. No. 5,368,630 to Luk, in addition to those disclosed in U.S. Pat. No. 5,330,792 to Johnson et al., each one of which is herein incorporated by reference in their entirety.

Generally, the organometallic lubricant comprises the entirety of the internal lubricant content. However, when the organometallic lubricant is combined with a conventional lubricant, it has been found that the improvements in physical properties resulting from the use of the organometallic lubricant are generally proportional to the amount of the organometallic lubricant relative to any other internal lubricants. Preferably, organometallic lubricants comprise at least 50 percent of the internal lubricant utilized with the metallurgical powder compositions. More preferably, organometallic lubricants comprise at least 70 percent, and still more preferably at least 90 weight percent, of the internal lubricant utilized with the metallurgical powder compositions. In some embodiments, organometallic lubricants comprise less than 25 weight percent, of the internal lubricant utilized with the metallurgical powder compositions.

The metallurgical powder composition may also contain one or more binding agents, particularly where an additional, separate alloying powder is used, to bond the different components present in the metallurgical powder composition so as to inhibit segregation and to reduce dusting. By "bond" as used herein, it is meant any physical or chemical method that facilitates adhesion of the components of the metallurgical powder composition.

Binding agents that can be utilized are those commonly employed in the powder metallurgical arts. For example, such binding agents include those found in U.S. Pat. No. 4,834,800, U.S. Pat. No. 4,483,905, U.S. Pat. No. 5,298,055, and U.S. Pat. No. 5,368,630, each of which is herein incorporated by reference in their entireties.

Such binding agents include, for example, polyglycols such as polyethylene glycol or polypropylene glycol; glycerine; polyvinyl alcohol; homopolymers or copolymers of vinyl acetate; cellulosic ester or ether resins; methacrylate polymers or copolymers; alkyd resins; polyurethane resins; polyester resins; or combinations thereof. Other examples of binding agents that are useful are the relatively high molecular weight polyalkylene oxide-based compositions described in U.S. Pat. No. 5,298,055 to Semel et al. Useful binding agents also include the dibasic organic acid, such as azelaic acid, and one or more polar components such as polyethers (liquid or solid) and acrylic resins as disclosed in U.S. Pat. No. 5,290,336 to Luk, which is incorporated herein by reference in its entirety. Additional useful binding agents include the cellulose ester resins, hydroxy alkylcellulose resins, and thermoplastic phenolic resins described in U.S. Pat. No. 5,368,630 to Luk.

The binding agent can further be a low melting, solid polymer or wax, e.g., a polymer or wax having a softening temperature of below 200° C. (390° F.), such as polyesters, polyethylenes, epoxies, urethanes, paraffins, ethylene bisstearamides, and cotton seed waxes, and also polyolefins with weight average molecular weights below 3,000, and hydrogenated vegetable oils that are $C_{14-24}$ alkyl moiety triglycerides and derivatives thereof, including hydrogenated derivatives, e.g. cottonseed oil, soybean oil, jojoba oil, and blends thereof, as described in WO 99/20689, published Apr. 29, 1999, which is hereby incorporated by reference in its entirety herein. These binding agents can be applied by the dry bonding techniques discussed in that application and in the general amounts set forth above for binding agents. Further binding agents that can be used in the present invention are polyvinyl pyrrolidone as disclosed in U.S. Pat. No. 5,069,714, which is incorporated herein in its entirety by reference, or tall oil esters.

The amount of binding agent present in the metallurgical powder composition depends on such factors as the density, particle size distribution and amounts of the iron-alloy powder, the iron powder and optional alloying powder in the metallurgical powder composition. Generally, the binding agent will be added in an amount of at least about 0.005 weight percent, more preferably from about 0.005 weight percent to about 2 weight percent, and most preferably from about 0.05 weight percent to about 1 weight percent, based on the total weight of the metallurgical powder composition.

Metallurgical powder compositions are prepared following conventional powder metallurgy techniques. Generally, metallurgical powder compositions are prepared by adding organometallic lubricant in particulate or liquid form to metal-based powders. Similarly, metallurgical powder compositions can be prepared by substantially coating the metal-based powder with solid organometallic lubricant. When added in dry form, the metal powder, organometallic lubricant, and optionally additional alloying powders (along with any other used additive, lubricant, and/or binder) are admixed together, using conventional powder metallurgy techniques, such as for example with a double cone blender to form a substantially homogeneous metallurgical blend.

In one embodiment, the metallurgical powder compositions comprises base metal powders substantially coated with solid or semisolid organometallic lubricant. These coated base metal particles are prepared by contacting a dry admixture of base metal powder and organometallic lubricant powder with sufficient solvent to wet the particles. Conventional solvents commonly known to those skilled in the metallurgical arts are utilized to soften and/or partially dissolve the surfaces of the polymeric particles, causing those particles to become tacky and to adhere or bond to the surfaces of the base metal particles. Preferably the solvent is applied to the dry admixture by spraying fine droplets of the solvent during mixing of the dry blend. Most preferably mixing is continued throughout the solvent application to ensure wetting of the polymer materials and homogeneity of the final mixture. The solvent is thereafter removed by evaporation, optionally with the aid of heating, forced ventilation, or vacuum. Mixing can be continued during the solvent removal step, which will itself aid evaporation of the solvent.

Compacted parts made from metallurgical powder compositions of the present invention are formed using conventional techniques. Typically, the metallurgical powder composition is poured into a die cavity and compacted under pressure, such as between about 5 and about 200 tons per square inch (tsi), more commonly between about 10 and 100 tsi. The compacted part is then ejected from the die cavity.

The compacted part is then heated to a temperature that transforms, i.e., degrades, the organometallic lubricant into a physical property enhancing alloying materials. Generally the compacted part is heated to a temperature of at least about 1700° F.

Preferably, the compacted part is sintered after compaction to enhance its strength. Sintering is preferably conducted at a temperature of at least 2000° F., more preferably at least about 2100° F., still more preferably at least about 2200° F., and even more preferably at least about 2250° F. The sintering step is conducted for a time sufficient to achieve metallurgical bonding and alloying.

Optionally, additional processes such as forging, infiltration, machining, or other conventional manufacturing technique or secondary operation are used to produce the finished part.

Those skilled in the art will appreciate that numerous changes and modifications may be made to the preferred embodiments of the invention and that such changes and modifications may be made without departing from the spirit of the invention. The following examples further describe the metallurgical powder compositions.

EXAMPLES

Physical properties of metallurgical powder compositions and of the green and sintered compacts were determined generally in accordance with the following formulas and test methods of the American Society for Testing and Materials and the Metal Powder Industries Federation:

| Property | Test Method |
|---|---|
| Apparent Density (g/cc) | ASTM B212-76 |
| Green Density (g/cc) | ASTM B331-76 |
| Green Strength (psi) | ASTM B312-76 |
| Dimensional Change (%) | ASTM B610-76 |
| Transverse Rupture Strength (ksi) | MPIF Std. 41 |
| Flow | ASTM B213-77 |
| Hardness | ASTM E18-84 |
| Green Expansion: | G.E. (%) = (100[(green bar length) − (die length)])/(die length) |

The following examples, which are not intended to be limiting, present certain embodiments and advantages of the present invention. Unless otherwise indicated, any percentages are on a weight basis.

Example 1

Metallurgical powder compositions composed of an organometallic lubricant were evaluated and compared to a reference powder composed of a conventional organic lubricant. Reference Composition I was prepared by admixing a prealloyed iron based powder and 0.75 weight percent of a conventional ethylene bis-stearamide wax lubricant (commercially available as Acrawax, from Glycol Chemical Co.). The prealloyed iron based powder included iron with 0.35 weight percent silicon, 4.4 weight percent nickel, 0.6 weight percent carbon (commercially available as Ancorloy MDC-L, from Hoeganaes Corp.).

Test Composition I was prepared by solvent bonding a prealloyed iron based powder with 0.75 weight percent of an organometallic lubricant, 4.4 weight percent nickel alloying powder (commercially available as "Inco 123" powder from Inco Limited), and 0.6 weight percent of graphite powder (commercially available as 3203 graphite, from Asbury Graphite Mills). The prealloyed iron based powder included iron prealloyed with 0.85 weight percent molybdenum (commercially available as Ancorsteel 85 HP, from Hoeganaes Corp.). The organometallic lubricant was a poly-[(methylsilylene)methylene] commercially available as Polycarbomethysilane, MW 800 from Sigma Aldrich Corporation. Test Composition II was prepared the same as Test Composition I except that the organometallic lubricant utilized was a methylpolysiloxane commercially available as SOC-A35 Oxycarbide from Starfire Systems, Inc., of Watervliet, N.Y.

Each composition was pressed into bars at a pressure of 50 tsi at room temperature. Test Composition I was also pressed at 170° F. The resulting bars were sintered at 2300° F. in a 90% $N_2$-10% $H_2$ atmosphere and then tempered at 400° F. for 1 hour. After sintering, Reference Composition I and Test Compositions I & II had roughly the same silicon content. Green and sintered physical properties are shown in Table 1:

TABLE 1

| | Test Composition I (Room Temp.) | Test Composition I (170° F.) | Test Composition II (Room Temp.) | Reference Composition I (Room Temp.) |
|---|---|---|---|---|
| Green Density (g/cc) | 7.09 | 7.26 | 7.13 | 7.20 |
| Green Expansion (%) | 0.22 | 0.11 | 0.27 | 0.15 |
| Sintered Density (g/cc) | 7.26 | 7.35 | 7.29 | 7.29 |
| Dimensional Change (%) | −0.56 | −0.43 | −0.58 | −0.46 |
| Transverse Rupture Strength (ksi) | 311 | 324 | 276 | 326 |
| Hardness $R_A$ | 64.5 | 66.8 | 59.6 | 67.6 |

As shown in Table 1, when pressed at room temperature metallurgical powder compositions composed of organometallic powders exhibited similar sintered density and transverse rupture strength compared to a composition that used a conventional lubricant. When pressed at 170 degrees Fahrenheit, metallurgical powder compositions composed of organometallic powders exhibited higher green density and sintered density compared to a composition that used a conventional lubricant.

Example 2

Metallurgical powder compositions composed of an organometallic lubricant were compacted at various temperatures and compared to a reference powder composed of a conventional organic lubricant. Test Composition III was prepared the same as Test Composition I except that 0.55 weight percent graphite powder was utilized. Bars of Test composition III and Reference Composition I were compacted at a pressure of 50 tsi at room temperature, 145° F., and 170° F. Powder properties and green physical properties are shown in Table 2:

TABLE 2

| | Test Comp. III (Room Temp.) | Test Comp. III (145° F.) | Test Comp. III (170° F.) | Reference Composition I (Room Temp.) |
|---|---|---|---|---|
| Apparent Density (g/cc) | 2.75 | 2.75 | 2.75 | 3.2 |
| Flow (Sec/50 g) | 30.7 | 30.7 | 30.7 | 29.4 |
| Green Density (g/cc) | 7.08 | 7.14 | 7.20 | 7.20 |
| Green Strength (psi) | 2200 | 2800 | 4200 | 1800 |
| Green Expansion (%) | 0.19 | 0.17 | 0.10 | 0.13 |
| Strip Pressure (psi) | 3600 | 2700 | 3500 | 2800 |
| Slide Pressure (psi) | 4400 | 2100 | 4000 | 2000 |

When pressed at 170 degrees Fahrenheit, metallurgical powder compositions composed of organometallic powders exhibited higher green strength and similar green density compared to a composition that used a conventional lubricant. When pressed at 145 degrees Fahrenheit, metallurgical powder compositions composed of organometallic powders required similar strip and slide force to eject the compacted part from the die compared to a composition that used a conventional lubricant.

Example 3

Metallurgical powder compositions composed of an organometallic lubricant were evaluated at different sintering temperatures and compared to a reference powder composed of a conventional organic lubricant. Test Composition III and Reference Composition I, as described above, were compacted at a pressure of 50 tsi and at a temperature of 170° F. The compacted bars were then sintered at 2150° and 2250° F. and tempered at 400° F. as set out above. Green and sintered physical properties of are shown in Table 3:

TABLE 3

| | Test Comp. III (2150° F.) | Reference Composition I (2150° F.) | Test Comp. III (2250° F.) | Reference Composition I (2250° F.) |
|---|---|---|---|---|
| Green Density (g/cc) | 7.22 | 7.18 | 7.22 | 7.19 |
| Green Expansion (%) | 0.11 | 0.14 | 0.12 | 0.14 |
| Sintered Density (g/cc) | 7.31 | 7.24 | 7.32 | 7.26 |
| Dimensional Change (%) | −0.33 | −0.27 | −0.41 | −0.35 |
| Weight Loss (%) | 0.39 | 0.90 | 0.42 | 0.88 |
| Transverse Rupture Strength (Ksi) | 299 | 295 | 327 | 319 |
| Hardness RA | 65.6 | 63.9 | 65.5 | 64.7 |

As shown in Table 3, metallurgical powder compositions composed of organometallic powders exhibited higher transverse rupture strength, green density, and sintered density (at both sintering temperatures) compared to a composition that used a conventional lubricant.

Example 4

Metallurgical powder compositions composed of an organometallic lubricant and a conventional lubricant were evaluated and compared to a reference powder composed of a conventional organic lubricant. Test Composition IV was prepared by solvent bonding a prealloyed iron based powder with 0.375 weight percent of an organometallic lubricant, 4.4 weight percent nickel alloying powder (commercially available as "Inco 123" powder from Inco Limited), and 0.55 weight percent of graphite powder (commercially available as 3203 graphite, from Asbury Graphite Mills). After solvent bonding, 0.375 weight percent of an ethylene bis-stearamide wax lubricant (commercially available as Acrawax, from Glycol Chemical Co.) was admixed with the solvent bonded solution. The prealloyed iron based powder included iron prealloyed with 0.85 weight percent molybdenum (commercially available as Ancorsteel 85 HP, from Hoeganaes Corp.). The organometallic lubricant was a poly-[(methylsilylene) methylene] commercially available as Polycarbomethysilane, MW 800 from Sigma Aldrich Corporation.

Test Composition V was the same as Test Composition IV except that the ethylene bis-stearamide wax lubricant was replaced with 0.375 weight percent of a conventional mixture of synthetic fatty diamide wax and zinc stearate that is commercially available as Kenolube from Hoeganaes Corporation of Riverton, N.J.

The compositions were compacted at 145° F. at a pressure of 50 tsi. The green compacted bars were sintered at 2300° F. and then tempered at 400° F., as described above. Powder properties and green properties are shown in Table 4:

TABLE 4

| | Test Composition IV | Test Composition V | Reference Composition I |
|---|---|---|---|
| Apparent Density (g/cc) | 3.09 | 3.08 | 3.20 |
| Flow (Sec/50 g) | 32.3 | 28.3 | 29.4 |
| Green Density (g/cc) | 7.21 | 7.22 | 7.25 |
| Green Strength (psi) | 2500 | 3500 | 2500 |
| Green Expansion (%) | 0.11 | 0.13 | 0.09 |
| Strip Pressure (psi) | 3000 | 3100 | 3200 |
| Slide Pressure (psi) | 2000 | 1300 | 1600 |

As shown in Table 4, metallurgical powder compositions composed of organometallic powders and a conventional lubricant required similar or lower strip and slide pressures to eject the green compact form the die compared to a composition that used a conventional lubricant. Moreover, the metallurgical powder compositions composed of organometallic powders and a conventional lubricant comprising synthetic fatty diamide wax and zinc stearate exhibited higher green strength compared to a composition that used a conventional lubricant.

Sintered properties are shown in Table 5:

TABLE 5

| | Test Composition IV | Test Composition V | Reference Composition I |
|---|---|---|---|
| Sintered Density (g/cc) | 7.33 | 7.28 | 7.30 |
| Dimensional Change (%) | −0.47 | −0.39 | −0.37 |
| Transverse Rupture Strength (ksi) | 340 | 326 | 334 |
| Hardness RA | 66.7 | 62.4 | 65 |
| Weight loss (%) | 0.68 | 0.72 | 0.88 |

As shown in Table 5, metallurgical powder compositions composed of an organometallic powder and a conventional ethylene bis-stearamide wax lubricant exhibited higher sintered density, transverse rupture strength, and hardness compared to a composition that used a conventional lubricant.

Silicon and carbon content are compared in Table 6:

TABLE 6

| | Test Composition IV | Test Composition V | Reference Composition I |
|---|---|---|---|
| % Silicon | 0.15 | 0.15 | 0.32 |
| % Carbon | 0.57 | 0.56 | 0.60 |

As shown in Tables 4, 5, and 6, metallurgical powder compositions composed of an organometallic powder and a conventional lubricant exhibit comparable or improved green and sintered properties, for example strength and hardness, even though they include only half as much silicon compared to the composition composed of a prealloyed powder that used a conventional lubricant.

Example 5

Metallurgical powder compositions composed of a conventional lubricant and organometallic lubricants of varying molecular weights were evaluated and compared to a reference powder composed of a conventional organic lubricant. Test Composition VI was prepared by solvent bonding a prealloyed iron based powder with 0.25 weight percent of an organometallic lubricant, 4.4 weight percent nickel alloying powder (commercially available as "Inco 123" powder from Inco Limited), and 0.6 weight percent of graphite powder (commercially available as 3203 graphite, from Asbury Graphite Mills). After solvent bonding, 0.5 weight percent of an ethylene bis-stearamide wax lubricant (commercially available as Acrawax, from Glycol Chemical Co.) was admixed with the solvent bonded solution. The prealloyed iron based powder included iron prealloyed with 0.85 weight percent molybdenum (commercially available as Ancorsteel 85 HP, from Hoeganaes Corp.). The organometallic lubricant was a poly-[(methylsilylene)methylene] that is commercially available as Polycarbomethysilane, MW 800 from Sigma Aldrich Corporation.

Test Composition VII was the same as Test Composition VI except that the 800 molecular weight poly-[(methylsilylene) methylene] was replaced with 1400 molecular weight poly-[(methylsilylene)methylene] that is commercially available as Polycarbomethysilane, MW 1400 from Sigma Aldrich Corporation.

The compositions were compacted at 50 tsi at room temperature. Powder properties and green properties are reported in Table 7:

TABLE 7

| | Test Composition VI | Test Composition VII | Reference Composition I |
|---|---|---|---|
| Apparent Density (g/cc) | 3.07 | 3.13 | 3.20 |
| Flow (Sec/50 g) | 32.1 | 32.6 | 29.4 |
| Green Density (g/cc) | 7.17 | 7.17 | 7.20 |
| Green Expansion (%) | 0.14 | 0.15 | 0.13 |
| Green Strength (psi) | 1962 | 1944 | 1946 |
| Strip Pressure (psi) | 2976 | 3135 | 2897 |
| Slide Pressure (psi) | 2098 | 2094 | 2025 |

Referring to tables 4 and 7, even when the organometallic powder content is decreased by 33% (to 0.25 weight percent) metallurgical powder compositions composed of an organometallic powder and a conventional lubricant still exhibit a green strength comparable to a composition having more than twice the total silicon content.

The green compacted bars were sintered at 2300° F. and then tempered at 400° F., as described above. Sinter properties are shown in Table 8:

TABLE 8

| | Test Composition VI | Test Composition VII | Reference Composition I |
|---|---|---|---|
| Sintered Density (g/cc) | 7.27 | 7.27 | 7.28 |
| Transverse Rupture Strength (ksi) | 334 | 325 | 330 |
| Weight loss (%) | 0.74 | 0.70 | 0.84 |

As shown in Table 8, metallurgical powder compositions composed of an organometallic powder and a conventional lubricant exhibit similar sintered properties compared to compositions composed of prealloyed powder admixed with a conventional internal lubricant, even though Test Compositions VI and VII contain less than half as much silicon.

Example 6

Metallurgical powder compositions composed of a conventional lubricant and organometallic lubricant in varying ratios were evaluated and compared to reference powders having varying amounts of silicon. Reference Composition II was prepared by admixing a prealloyed iron based powder, 4.4 weight percent nickel alloying powder (commercially available as "Inco 123" powder from Inco Limited), and 0.6 weight percent of graphite powder (commercially available as 3203 graphite, from Asbury Graphite Mills). The prealloyed iron based powder included iron prealloyed with 0.85 weight percent molybdenum (commercially available as Ancorsteel 85 HP, from Hoeganaes Corp.). After admixing, the composition was solvent bonded with 0.75 weight percent of an ethylene bis-stearamide wax lubricant (commercially available as Acrawax, from Glycol Chemical Co.).

Reference Composition III was prepared in the same manner as Reference Composition II except that it also contained a silicon alloying additive that provided a total silicon content of about 0.2 weight percent. Reference Composition IV was prepared in the same manner as Reference Composition II except that it contained 0.5 weight percent of silicon alloying additive. Addition of the silicon alloying additive gave Reference Composition III a total silicon content of about 0.1 weight percent.

Test Composition VIII was prepared by solvent bonding a prealloyed iron based powder with 0.20 weight percent of an organometallic lubricant, 4.4 weight percent nickel alloying powder (commercially available as "Inco 123" powder from Inco Limited), and 0.6 weight percent of graphite powder (commercially available as 3203 graphite, from Asbury Graphite Mills). After solvent bonding, 0.55 weight percent of an ethylene bis-stearamide wax lubricant (commercially available as Acrawax, from Glycol Chemical Co.) was admixed with the solvent bonded composition. The prealloyed iron based powder included iron prealloyed with 0.85 weight percent molybdenum (commercially available as Ancorsteel 85 HP, from Hoeganaes Corp.). The organometallic lubricant was a poly-[(methylsilylene)methylene] commercially available as Polycarbomethysilane, MW 800 from Sigma Aldrich Corporation.

Test Composition IX was prepared in the same manner as Test Composition VIII except that it contained 0.15 weight percent of the organometallic lubricant and 0.6 weight percent of the ethylene bis-stearamide wax lubricant. Test Composition X was prepared in the same manner as Test Composition VIII except that it contained 0.10 weight percent of the organometallic lubricant and 0.65 weight percent of the ethylene bis-stearamide wax lubricant.

The compositions were compacted at 50 tsi at room temperature. The resultant green compacted bars were sintered at 2300° F. and then tempered at 400° F., as described above. Green properties and sintered properties are reported in Table 8:

TABLE 9

| | Silicon Content (wt. %) | Green Density (g/cc) | Green Expan. (%) | Sintered Density (g/cc) | Dim. Change (%) | Trans. Rupture Strength (ksi) | Hardness RA |
|---|---|---|---|---|---|---|---|
| Ref. Comp. I | 0.32 | 7.19 | 0.11 | 7.27 | −0.44 | 321 | 65.7 |
| Ref. Comp. III | 0.2 | 7.17 | 0.13 | 7.27 | −0.48 | 311 | 64.9 |
| Ref. Comp. IV | 0.1 | 7.17 | 0.13 | 7.27 | −0.50 | 310 | 64.7 |
| Ref. Comp. II | 0.0 | 7.17 | 0.11 | 7.24 | −0.48 | 307 | 64.8 |
| Test Comp. VII | ~0.125 | 7.18 | 0.15 | 7.27 | −0.42 | 321 | 62.7 |
| Test Comp VIII | ~0.1 | 7.18 | 0.15 | 7.28 | −0.43 | 322 | 61.5 |
| Test Comp. IX | ~0.075 | 7.18 | 0.15 | 7.29 | −0.43 | 313 | 60.6 |
| Test Comp. X | ~0.05 | 7.19 | 0.15 | 7.28 | −0.42 | 320 | 63.6 |

As shown in Table 8, powder compositions composed of prealloyed powders and a conventional lubricant exhibited a 15% decrease in transverse rupture strength as the total silicon content decreased. In contrast, metallurgical powder compositions composed of an organometallic lubricant did not exhibit a decrease in transverse rupture strength when the total silicon content decreased. Moreover, metallurgical powder compositions composed of an organometallic lubricant exhibited similar or better sinter properties compared to compositions that used a conventional lubricant.

What is claimed:

1. A metallurgical powder composition comprising:

at least 80 percent by weight of an iron based powder or a nickel based powder; and from about 0.1 to about 5 weight percent of an organometallic lubricant having the formula:

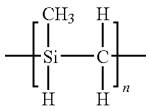

wherein n is an integer from 1 to 1000.

2. The metallurgical powder composition of claim 1 wherein n is an integer from 4 to 100.

3. The metallurgical powder composition of claim 1 wherein the organometallic lubricant has a molecular weight average of from about 200 to about 10,000.

4. The metallurgical powder composition of claim 1 wherein the organometallic lubricant has a molecular weight average of from about 200 to about 4000.

5. The metallurgical powder composition of claim 1 wherein the metallurgical powder composition comprises a prealloyed iron-based powder.

6. The metallurgical powder composition of claim 1 wherein the metallurgical powder composition comprises a prealloyed nickel-based powder.

7. The metallurgical powder composition of claim 1 further comprising at least one alloying powder.

8. The metallurgical powder composition of claim 1 wherein the metallurgical powder composition includes from about 0.05 to about 3 weight percent silicon.

9. A powder metallurgy compacted part comprising the metallurgical powder composition of claim 1.

* * * * *

UNITED STATES PATENT AND TRADEMARK OFFICE

CERTIFICATE OF CORRECTION

PATENT NO. : 7,604,678 B2
APPLICATION NO. : 10/918604
DATED : October 20, 2009
INVENTOR(S) : George Poszmik It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1352 days.

Signed and Sealed this

Fifth Day of October, 2010

David J. Kappos

David J. Kappos
*Director of the United States Patent and Trademark Office*